US007163340B2

(12) United States Patent
Godshaw et al.

(10) Patent No.: US 7,163,340 B2
(45) Date of Patent: Jan. 16, 2007

(54) FOLDING BAG CONSTRUCTION

(75) Inventors: Donald E. Godshaw, Evanston, IL (US); Andrejz M. Redzisz, Wheeling, IL (US)

(73) Assignee: Travel Caddy, Inc., Elk Grove Village, IL (US)

( * ) Notice: Subject to any disclaimer, the term of this patent is extended or adjusted under 35 U.S.C. 154(b) by 552 days.

(21) Appl. No.: 10/758,058

(22) Filed: Jan. 15, 2004

(65) Prior Publication Data

US 2005/0157960 A1 Jul. 21, 2005

(51) Int. Cl.

| | |
|---|---|
| ***B65D 30/10*** | (2006.01) |
| ***B65D 33/00*** | (2006.01) |
| ***B65D 33/16*** | (2006.01) |
| ***B65D 33/02*** | (2006.01) |
| ***B65D 30/00*** | (2006.01) |
| ***A45C 7/00*** | (2006.01) |

(52) U.S. Cl. ..... 383/121; 383/41; 383/67; 383/97; 383/119; 383/121.1; 190/107

(58) Field of Classification Search ..... 383/121–121.1, 383/119, 67, 41, 97; 190/107
See application file for complete search history.

(56) References Cited

U.S. PATENT DOCUMENTS

| | | | | |
|---|---|---|---|---|
| 4,136,726 | A * | 1/1979 | Lee | 206/316.2 |
| 5,964,533 | A * | 10/1999 | Ziglar | 383/36 |
| 6,068,402 | A * | 5/2000 | Freese et al. | 383/110 |

* cited by examiner

*Primary Examiner*—Jes F. Pascua
(74) *Attorney, Agent, or Firm*—Banner & Witcoff, Ltd.

(57) ABSTRACT

A folding bag has a generally rectangular parallelepiped shape with rigid lateral front and backsides and a flexible bottom panel with a diagonal slit that enables folding of the bag into a compact flat configuration. A rigid folding panel is provided on the inside of the bag to enable maintenance of the bottom side in a generally fixed configuration and to maintain the shape of the bag.

9 Claims, 2 Drawing Sheets

FIG. 3
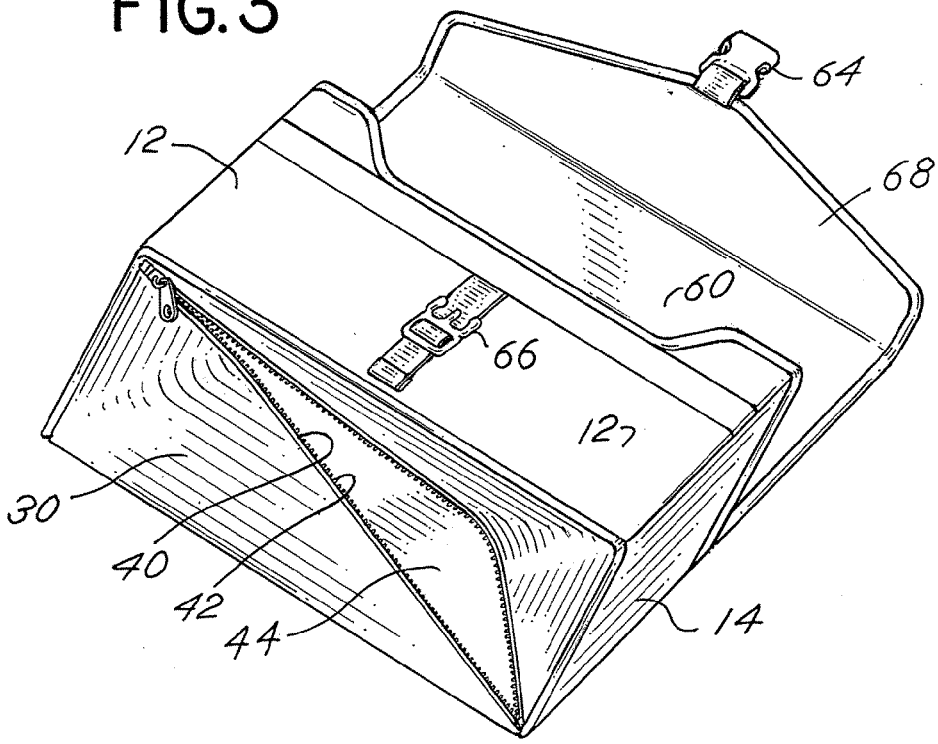
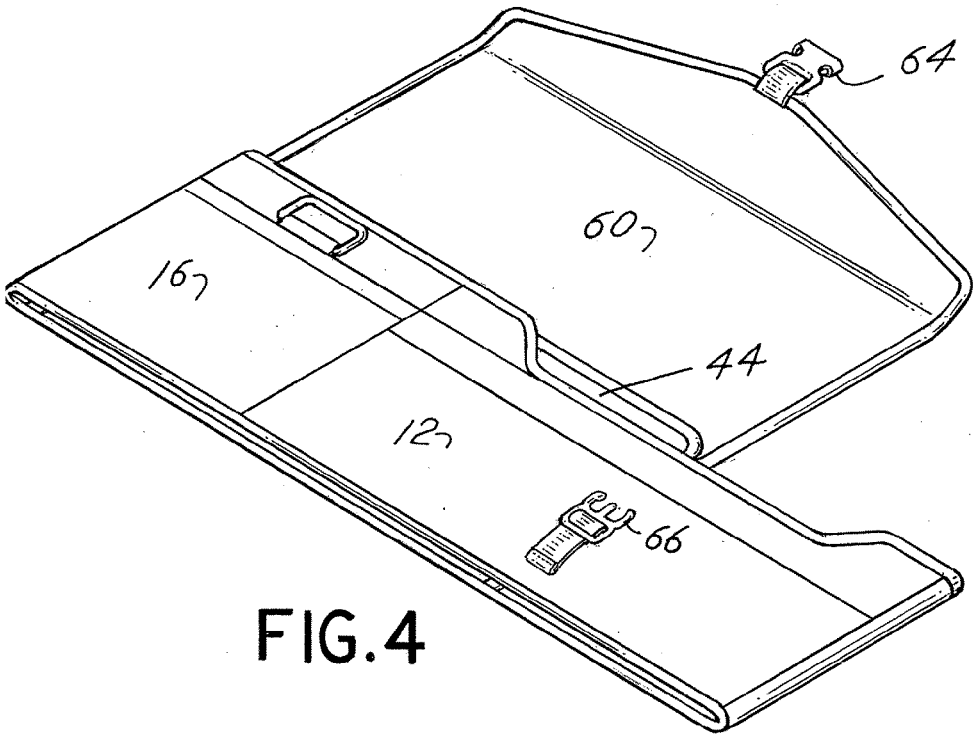
FIG. 4

FOLDING BAG CONSTRUCTION

BACKGROUND OF THE INVENTION

In a principal aspect, the present invention relates to a generally parallelepiped bag construction having generally rigid side panels and a flexible bottom panel to enable the bag to be folded for purposes of storage, shipment and display, yet assembled in a rigid form for use as a tool bag or the like.

The use of bags, particularly generally parallelepiped bags for tools by workmen, craftsmen and sportsmen to carry their gear is a well-known expedient. Typically, such bags include lateral sides and bottom with a top cover that enables protection of the contents of the bag. Preferably, the lateral sides and the bottom side of the bag are rigid or stiff so as to further protect the contents and facilitate movement and carrying of such a bag.

However, the storage of such bags, as well as the packaging and shipping of such bags, requires significant amounts of space inasmuch as the internal portion of the bag is generally empty. Thus, a bag which is comprised of generally rigid panels in a parallelepiped form can be costly to store, ship and display.

To overcome such disadvantages, soft-sided bags have been developed. Thus, a bag having a rigid bottom panel and soft lateral sides may be folded for purposes of storage, transport, display and the like. However, with such a construction, the soft sides of the bag do not provide the type of protection and physical integrity to protect the contents of the bag once the bag is in use. Thus, there has developed the need for a folding bag constructed of multiple, generally rigid lateral sides and a bottom side connected one to the other.

BRIEF SUMMARY OF THE INVENTION

Briefly, the present invention comprises a folding bag having a generally rectangular parallelepiped configuration wherein all the sides of the bag, except the bottom side, may be formed of generally rigid panels connected by flexible hinges. The bottom side is made from a flexible material and includes a zipper opening connecting diagonal corners of the bottom side. Positioned within the bag and along a seam joining one of the lateral sides to the bottom side is a rigid panel which may be folded against the bottom side or folded away from the bottom side. Thus the bag, when folded for storage, requires that the zipper opening be released so that the flexible bottom side may be folded as the rigid bottom panel attached thereto may be folded away from the bottom side and the lateral sides may be collapsed upon one another. The bag will then have a flat configuration wherein all of the sides are folded upon one another for purposes of storage, shipping and later assembly. Assembly is simplified inasmuch as the bag is merely unfolded to close the zipper slot in the bottom side and the rigid bottom panel is folded down over the bottom side into position to maintain the parallelepiped configuration of the bag. The folding bag further includes a hinged top side which may be closed and retained by a clasp or fastener mechanism.

Thus, it is an object of the invention to provide a folding, rigid sided bag.

It is a further object of the invention to provide a folding rigid sided bag wherein the bottom panel of the bag is flexible and includes a diagonal slit connecting non-adjacent corners of the bag.

Yet another object of the invention is to provide a folding bag which may be used as a tool bag, a sport bag, or for any other purpose wherein the bag has a generally rectangular parallelepiped configuration when assembled for use.

A further object of the invention is to provide a folding bag comprised of generally rigid lateral sides and a flexible bottom side with a folding bottom panel which is generally rigid and congruent with the bottom side.

Another object of the invention is to provide a folding bag construction which is easy to assemble, inexpensive, rugged and which enables maintenance of the contents of the bag when in an assembled condition to be easily protected.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 3 is an isometric view depicting the bag of FIG. 2 from the opposite or bottom side thereof and further depicting the manner in which the rigid bottom panel of the bag may be positioned for folding of the bag; and FIG. 4 is an isometric view of the bag of FIG. 1 in the folded condition.

DESCRIPTION OF THE PREFERRED EMBODIMENT

Figure 1:
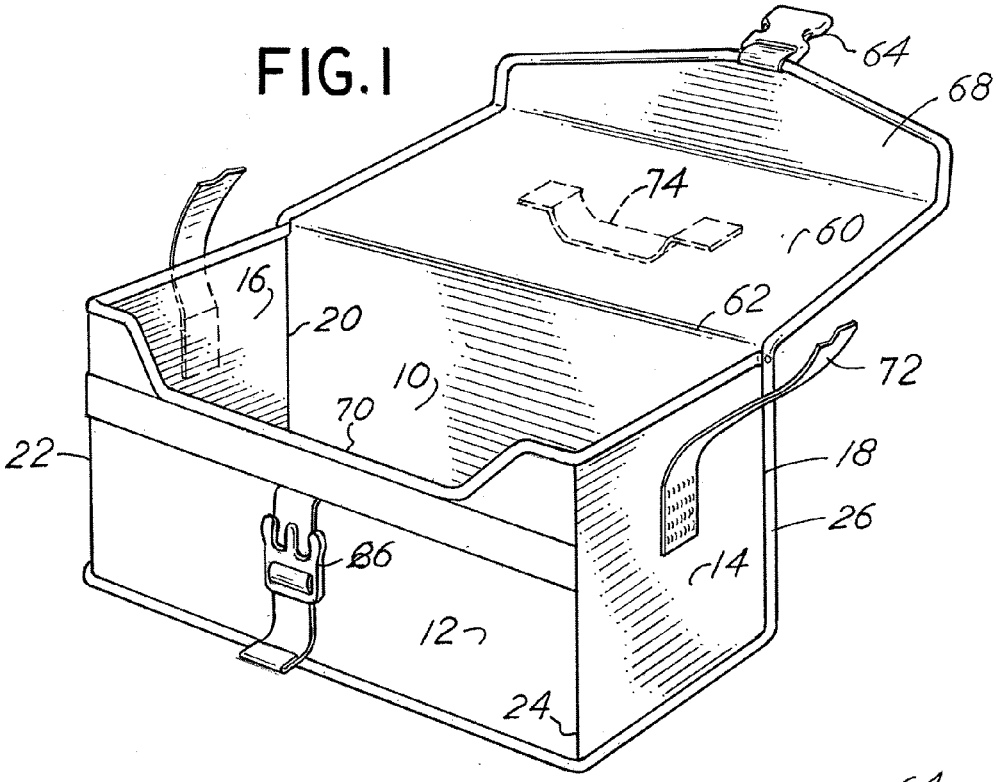
FIG. 1 is an isometric view of a preferred embodiment of the folding bag of the invention wherein the bag is in a fully assembled condition.

Referring to the figures, a generally rectangular parallelepiped bag includes a generally rigid back side 10, a generally rigid, parallel, front side 12, a first generally rigid, lateral side 14 and a spaced generally parallel, rigid second lateral side 16. Each of the sides 10, 12, 14 and 16 are attached sequentially one to the other along flexible seams such as seams 18, 20, 22, and 24. In practice, the panels or sides 10, 12, 14 and 16 may, for example, comprise a polyethylene board enclosed in a fabric sleeve wherein the polyethylene board forms each of the separate sides 10, 12, 14 and 16 and the sleeve encloses or enshrouds each of the sides 10, 12, 14, 16 and connects to form the flexible seams 18, 20, 22 and 24. Cording or ribbing, such as ribbing 26, may be used to connect the fabric seams.

The folding bag further includes a generally rectangular bottom side 30. The bottom side 30 is comprised of flexible material such as plastic, canvas or the like. The bottom panel 30 includes four corners 32, 34, 36, and 38. A diagonal slit 40 connects non-adjacent corners 34 and 38. The slit 40 includes a zipper device 42 which enables opening and closing of the slit 40.

A rigid bottom panel 44 is attached to a seam 46 which permits the panel 44 to pivot as a flexible hinge. Bottom panel 44 is generally congruent in size and shape with the bottom side 30. Thus, the panel 44 which may, for example, comprise a generally rigid polyethylene board encapsulated or enclosed in a fabric sleeve. Panel 44 may be folded about the seam 46 against the bottom side 30 to provide for maintenance of the form and shape of the bottom side 30 and the bag due to engagement of the sides of panel 44 against lateral sides 10, 12, 14 and 16. The bottom panel 44 may, for example, also incorporate fasteners, such as Velcro fasteners 50, which engage with a Velcro fastener 52, by way of example, on the inside, bottom side 30 to hold or retain the panel 44 in position against the bottom side 30 thereby maintaining the shape and configuration of the folding bag.

Figure 2:
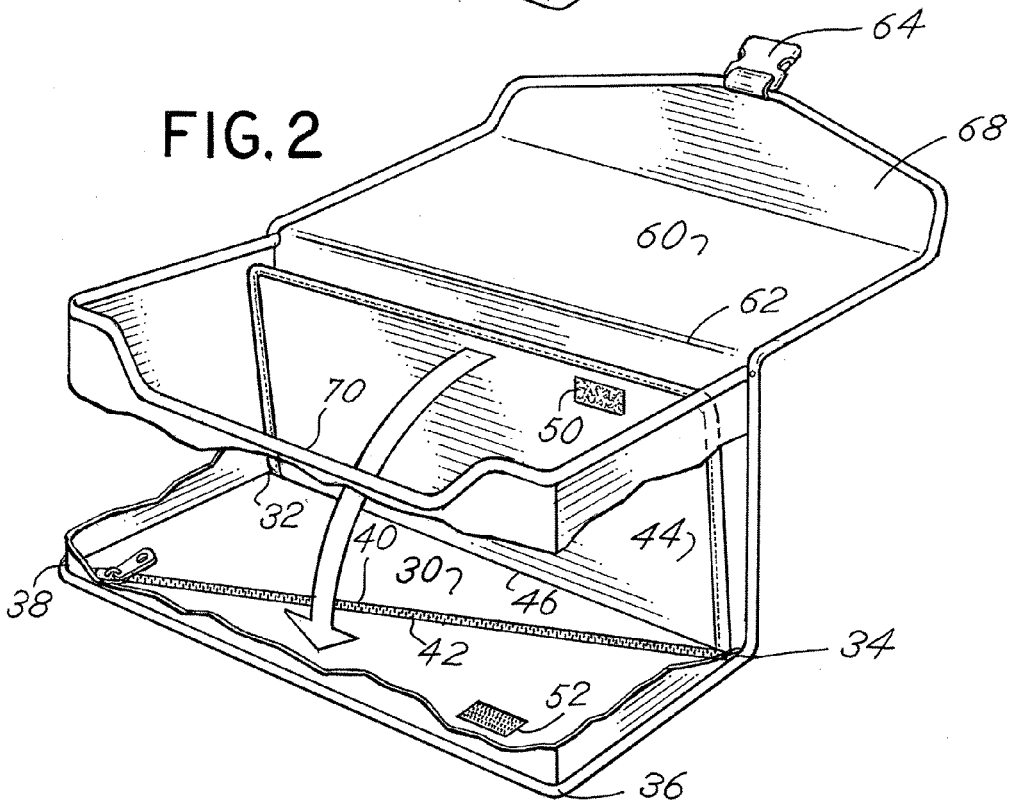
FIG. 2 is a cut-away, isometric view of the bag of FIG. 1 illustrating the manner of assembly and disassembly of the bag between the open or ready-to-use condition and the storage or folded condition.

Thus, when assembling the folding bag to the condition depicted in FIG. 1, the bottom panel 44 will be folded in the direction of the arrow in FIG. 2 to engage against the bottom side 30. By so engaging against the bottom side 30 and due to the fact that all of the sides 10, 12, 14, 16, except for the bottom side 30, are generally rigid, a generally rigid bag results in the assembled condition as depicted in FIG. 1. Of course, reversing the process by releasing the bottom panel 44 from the bottom side 30, enables folding of the bag once the zipper 42 is opened. Thus, as depicted in FIG. 3, when the zipper 42 is opened, because the bottom side 30 is flexible, the sides 10, 12, 14, 16 of the bag may be folded about their various flexible hinges 18, 20, 22 and 24 to the configuration depicted in FIG. 4. Thus, all of the sides 10, 12, 14, and 16, the bottom panel 44 may all be folded into a flat configuration inasmuch as the bottom side 30 is flexible and due to the diagonal slot 40 which enables folding thereof by movement of those sides in the manner depicted by the arrow in FIG. 3. Note that the slit or slot 40 enables folding in the direction of the arrow only.

The folding bag construction of the invention may further include a top side 60 foldable about a flexible seam 62. The top side 60 may thus be flexible or generally rigid having a construction similar to the other sides previously described. The top side 60 may then be folded about the seam or flexible hinge section 62 to close the bag. A clasp or fastener 64 on the top side may be engaged with a compatible clasp 66 attached to the front side 12. The top side 60 may also include an extra flap section 68 to insure that the top side 60 will be retained over the open top of the bag. Additionally, the front side 12 may include a recessed forward section 70, in FIG. 2, which will facilitate access to the bag. The particular shape and configuration of the front side 12, thus, may be varied to accommodate desired needs and utility of the bag. A strap 72 may be provided connecting the lateral sides 14 and 16. A carry handle 74 may be provided on the outside of the top side 60 again for carrying the bag.

In practice, then each of the generally rigid panels forming the sides 10, 12, 14 and 16 as well as the top side 60 may comprise a material board retained with a fabric sleeve. Importantly, however, the bottom side 30 is a flexible material such as fabric, plastic, canvas or the like. Also importantly, the diagonal slot 40 extends between non-adjacent corners of the bottom side 30.

The invention has been described in the context of a generally rectangular parallelepiped structure. It is possible to alter the construction somewhat to other geometric configurations while maintaining the integrity and features of the invention. Thus, while there has been set forth a preferred embodiment of the invention, it is to be understood that the invention is limited only by the following claims and equivalents thereof.

What is claimed is:

1. A folding bag comprising, in combination:

a generally rectangular parallelepiped container having at least five sides including a flexible material, generally rectangular bottom side having four corners, a front side, a back side spaced from the front side, a first lateral end side and a second lateral end side spaced from the first end side, said sides joined by flexible junctures to enable said lateral, front and back sides to be folded relative to each other, said bottom side including a diagonal slit extending between non-adjacent corners and a material connection device for joining the sides of the slit; and a generally rigid panel generally congruent in size and shape with the bottom side, said rigid panel flexibly attached along a seam between the bottom side and one of the other sides of the bag whereby the rigid panel may be folded against the bottom side to maintain the bottom side configured in a rectangular shape, and pivotal about the seam from the bottom side to enable collapsible folding of the bag.

2. The bag of claim 1 wherein the material connecting device in the bottom side comprises a zipper.

3. The bag of claim 1 wherein at least one of said front side, back side, first end side and second end side is generally a rigid side.

4. The bag of claim 1 wherein said front side, back side, first end side and second end side are generally rigid.

5. The bag of claim 1 further including a top side attached by a flexible hinge to one of the sides.

6. The bag of claim 1 further including a top side attached by a flexible hinge to the backside.

7. The bag of claim 6 including a latching device for attaching the top side to the front side.

8. The bag of claim 1 wherein the rigid panel is attached by a flexible hinge to the seam between the back side and bottom side.

9. The bag of claim 1 wherein the rigid panel comprises a panel member encased within a fabric sleeve.

* * * * *